US011016426B1

(12) United States Patent
Kikuchi

(10) Patent No.: US 11,016,426 B1
(45) Date of Patent: May 25, 2021

(54) FIXING DEVICE AND IMAGE FORMING APPARATUS

(71) Applicant: TOSHIBA TEC KABUSHIKI KAISHA, Tokyo (JP)

(72) Inventor: Kazuhiko Kikuchi, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/937,012

(22) Filed: Jul. 23, 2020

(30) Foreign Application Priority Data

Nov. 1, 2019 (JP) ..... JP2019-199884

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/2017; G03G 15/2032; G03G 15/2039; G03G 15/2042; G03G 15/2046; G03G 15/2053; G03G 2215/2003
See application file for complete search history.

(56) References Cited

U.S. PATENT DOCUMENTS

| | | | | |
|---|---|---|---|---|
| 9,217,971 | B1 | 12/2015 | Matsumoto et al. | |
| 2002/0018676 | A1* | 2/2002 | Hirai | G03G 15/2064 399/329 |
| 2016/0139551 | A1* | 5/2016 | Narahara | G03G 15/55 399/33 |
| 2017/0102651 | A1* | 4/2017 | Tanaka | G03G 15/2039 |
| 2019/0113868 | A1* | 4/2019 | Akizuki | G03G 15/2028 |
| 2020/0192259 | A1* | 6/2020 | Morihara | G03G 15/2053 |
| 2020/0363761 | A1* | 11/2020 | Watanabe | G03G 15/2053 |

FOREIGN PATENT DOCUMENTS

| | | | |
|---|---|---|---|
| JP | 2003257592 | A * | 9/2003 |
| JP | 2017187599 | A | 10/2017 |

* cited by examiner

*Primary Examiner* — Thomas S Giampaolo, II
(74) *Attorney, Agent, or Firm* — Kim & Stewart LLP

(57) ABSTRACT

According to one embodiment, a fixing device, includes a fixing member having a first surface configured to be pressed against a recording medium and a heater on a second surface of the fixing member. A first heat conducting member contacts aback surface side of the heater, and a second heat conducting member is provided to be moveable between a first state, in which the second heat conducting member is in contact with the first heat conducting member and the second surface of the fixing member, and a second state, in which the second heat conducting member is contacting the first heat conducting member, but separated from the second surface of the fixing member.

20 Claims, 8 Drawing Sheets

FIXING DEVICE AND IMAGE FORMING APPARATUS

CROSS-REFERENCE TO RELATED APPLICATION

This application is based upon and claims the benefit of priority from Japanese Patent Application No. 2019-199884, filed Nov. 1, 2019, the entire contents of which are incorporated herein by reference.

FIELD

Embodiments described herein relate generally to a fixing device and an image forming apparatus.

BACKGROUND

In the related art, an image forming apparatus has been developed in which a recording material is fixed to a recording medium by a so-called "on-demand heat" fixing device using a thin-film type fixing belt (also referred to as a "fixing film"). In such a fixing device, a heat conducting member having high thermal conductivity may be on the side of a heater element opposite to the side of the heater base having a surface (a contact surface) in physical contact with the fixing film. In such a case, the heat conducting member can be arranged so that a part thereof also contacts the fixing film. According to such a configuration, the productivity of the image forming processing can be improved by controlling the temperature of the heater element based on the temperature change of the recording medium detected via monitoring the temperature of the heat conducting member. Further, according to such a configuration, the heat of the heater element is transmitted to the heat conducting member, so that an excessive rise in the temperature of the heater element can be suppressed. Furthermore, according to such a configuration, the heat radiated from the heater element in the direction opposite to the contact surface with the fixing film can still be used for heating the fixing film by the conductance of the heat conducting member.

However, in such a fixing device, a heat conducting member having a large heat capacity is typically used, and thus it takes a relatively long time to raise the temperature of the heat conducting member. Therefore, until the temperature of the heat conducting member rises to an operating temperature, heat from the fixing film is withdrawn by the heat conducting member, and the heating of the fixing film to a necessary operating temperature (or maintence of the necessary operating temperature) is hindered. For this reason, in a fixing device in the related art, it may take a long time to transition from one operating state to another, particularly from a state where the temperature of the heat conducting member is low to a state where the image forming processing can be performed.

DETAILED DESCRIPTION

According to at least one embodiment, a fixing device and an image forming apparatus that can more efficiently control the temperature of a fixing film in the fixing device having a heat conducting member that provides heat exchange between a heater element and the fixing film.

In general, according to one embodiment, a fixing device, comprises a fixing member having a first surface configured to be pressed against a recording medium. A heater is provided on a second surface of the fixing member and is configured to heat the fixing member. A first heat conducting member contacts aback surface side of the heater. A second heat conducting member is provided. The second heat conducting member is moveable between a first state, in which the second heat conducting member is in contact with the first heat conducting member and the second surface of the fixing member, and a second state, in which the second heat conducting member is contacting the first heat conducting member, but separated from the second surface of the fixing member.

Hereinafter, a fixing device and an image forming apparatus according to certain example embodiments will be described with reference to the drawings.

First Embodiment

Figure 1:
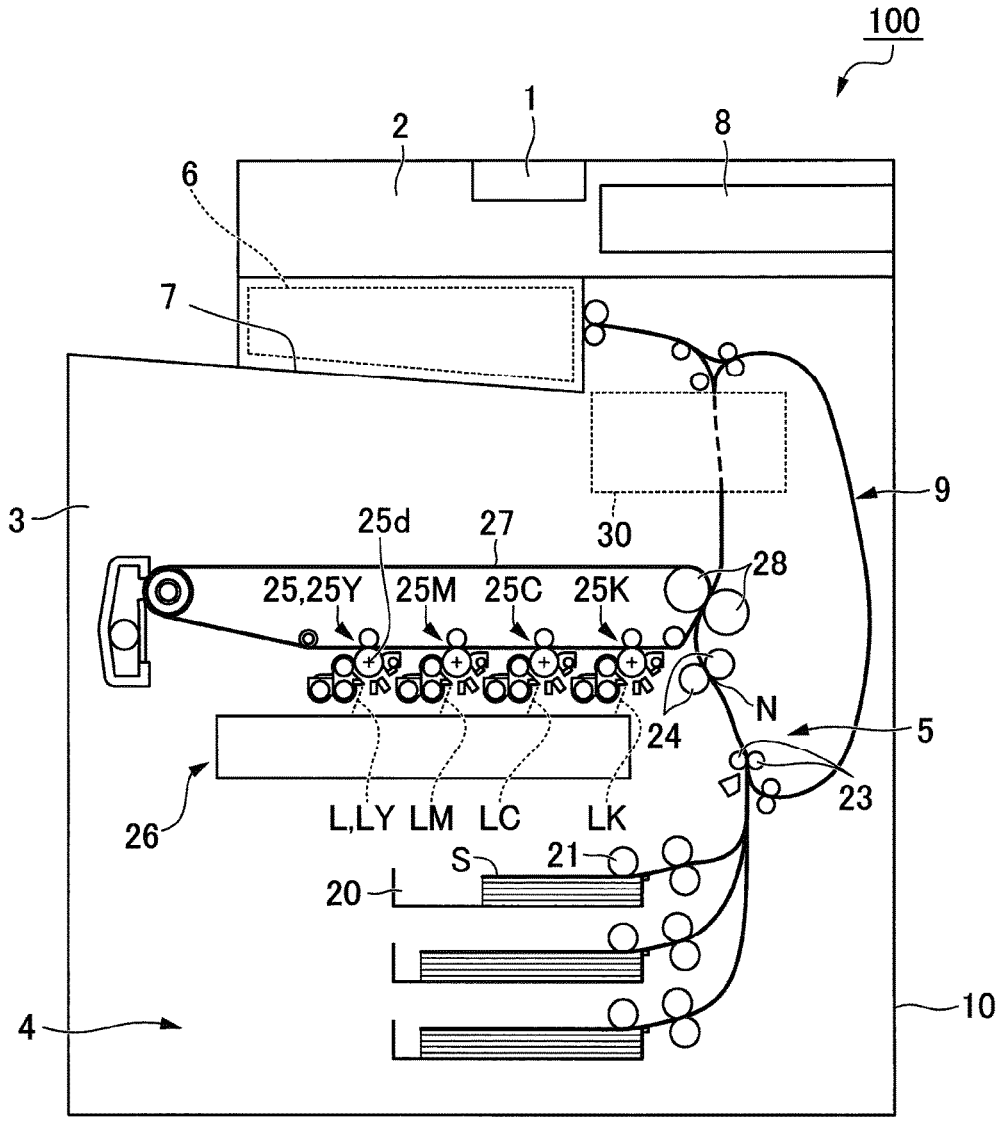
FIG. 1 is a diagram schematically illustrating a configuration of an image forming apparatus according to a first embodiment.

FIG. 1 is a diagram schematically illustrating a configuration of an image forming apparatus according to a first embodiment. An image forming apparatus 100 according to the first embodiment is, for example, a multifunction peripheral (MFP) device. The image forming apparatus 100 includes a housing 10, a display 1, a scanner unit 2, an image forming unit 3, a sheet feeding unit 4, a conveyance unit 5, a sheet discharge tray 7, a reversing unit 9, a control panel 8, and a control unit 6. The image forming unit 3 may be a device for fixing a toner image or may be an inkjet type device.

In this example, the image forming apparatus 100 forms an image on a sheet S using a developer such as a toner. The sheet S is, for example, paper or label paper. The sheet S may be any type as long as the image forming apparatus 100 can form an image on the surface thereof.

The housing 10 forms the outer shape (casing) of the image forming apparatus 100. The display 1 is an image display device such as a liquid crystal display and an organic electro luminescence (EL) display. The display 1 displays various types of information related to the image forming apparatus 100.

The scanner unit 2 reads image information from a document based on brightness and darkness of reflected light or the like. The scanner unit 2 records the read image information. The scanner unit 2 outputs the generated image information to the image forming unit 3. The recorded image information may also, or instead, be transmitted to or from another information processing device (e.g., an external computer or the like) via a network.

The image forming unit 3 forms a toner image with toner (or other recording material) based on the image information received from the scanner unit 2 or the image information received from the outside. The image forming unit 3 transfers the toner image onto the surface of the sheet S. The image forming unit 3 fixes the toner image to the sheet S by heating and pressing the toner image on the surface of the sheet S. other aspects of the image forming unit 3 will be described later. The sheet S may be a sheet supplied by the sheet feeding unit 4 or may be a manually fed sheet.

The sheet feeding unit 4 supplies the sheets S to the conveyance unit 5 one by one at a timing coordinated with the timing at which the image forming unit 3 forms a toner image. The sheet feeding unit 4 includes a sheet storage unit 20 and a pickup roller 21.

The sheet storage unit 20 stores sheets S of a predetermined size and type. The pickup roller 21 picks up the sheets S one by one from the sheet storage unit 20. The pickup roller 21 supplies the picked up sheet S to the conveyance unit 5.

The conveyance unit 5 conveys the sheet S from the sheet feeding unit 4 to the image forming unit 3. The conveyance unit 5 includes conveyance rollers 23 (also referred to as a roller pair 23) and registration rollers 24 (also referred to as a roller pair 24). The conveyance rollers 23 convey the sheet S from the pickup roller 21 to the registration rollers 24. The leading end of the sheet S in the conveyance direction is conveyed by the roller pair 23 to abut on a nip N of the registration rollers 24.

The registration rollers 24 adjust the timing position of the leading end of the sheet S by, for example, bending the sheet S at the nip N before passing the sheet S through the nip N. The registration rollers 24 convey the sheet S to appropriately match up with the timing at which the image forming unit 3 will transfer the toner image onto the sheet S.

The image forming unit 3 includes a plurality of image forming units 25, a laser scanning unit 26, an intermediate transfer belt 27, a transfer unit 28, and a fixing device 30. The image forming unit 25 includes a photosensitive drum 25*d*. The image forming unit 25 forms a toner image on the photosensitive drum 25*d* according to the image information from the scanner unit 2 or the outside. The plurality of image forming units 25Y, 25M, 25C, and 25K form toner images using yellow, magenta, cyan, and black toners, respectively.

A charger, a developing device, and the like are arranged around the photosensitive drum 25*d*. The charger electrostatically charges the surface of the photosensitive drum 25*d*. The developing devices contain a developer containing yellow, magenta, cyan, or black toners. The developing device supplies toner to develop an electrostatic latent image on the photosensitive drum 25*d*. As a result, a toner image is formed on the photosensitive drums 25*d*, one for each color being utilized according to the image information.

The laser scanning unit 26 scans the electrostatically charged photosensitive drum 25*d* with a laser beam L to selectively expose portions of the photosensitive drum 25*d* according to the image information. The laser scanning unit 26 exposes the photosensitive drums 25*d* of the image forming units 25Y, 25M, 25C, and 25K with respectively different laser beams LY, LM, LC, and LK. Thereby, the laser scanning unit 26 forms an electrostatic latent image on each of the photosensitive drums 25*d*.

The toner image on the surface of the photosensitive drum 25*d* is first transferred to the intermediate transfer belt 27 (primary transfer). The transfer unit 28 then transfers the toner image from intermediate transfer belt 27 onto the surface of the sheet S at a secondary transfer position (secondary transfer). The fixing device 30 heats and presses the toner image transferred to the sheet S to fix the toner image to the sheet S.

The reversing unit 9 reverses an orientation of the sheet S so an image can be formed on the back surface of the sheet S. The reversing unit 9 reverses the sheet S discharged from the fixing device 30 using a switchback or the like. The reversing unit 9 conveys the reversed sheet S toward the registration rollers 24.

The sheet discharge tray 7 stores the sheet S having an image formed thereon that have been discharged after fixing. The control panel 8 includes a plurality of buttons. The control panel 8 receives a user operation. The control panel 8 outputs a signal corresponding to an operation performed by the user to the control unit 6 of the image forming apparatus 100. The display 1 and the control panel 8 may be configured as an integrated touch panel. The control unit 6 controls each unit of the image forming apparatus 100.

Figure 2:
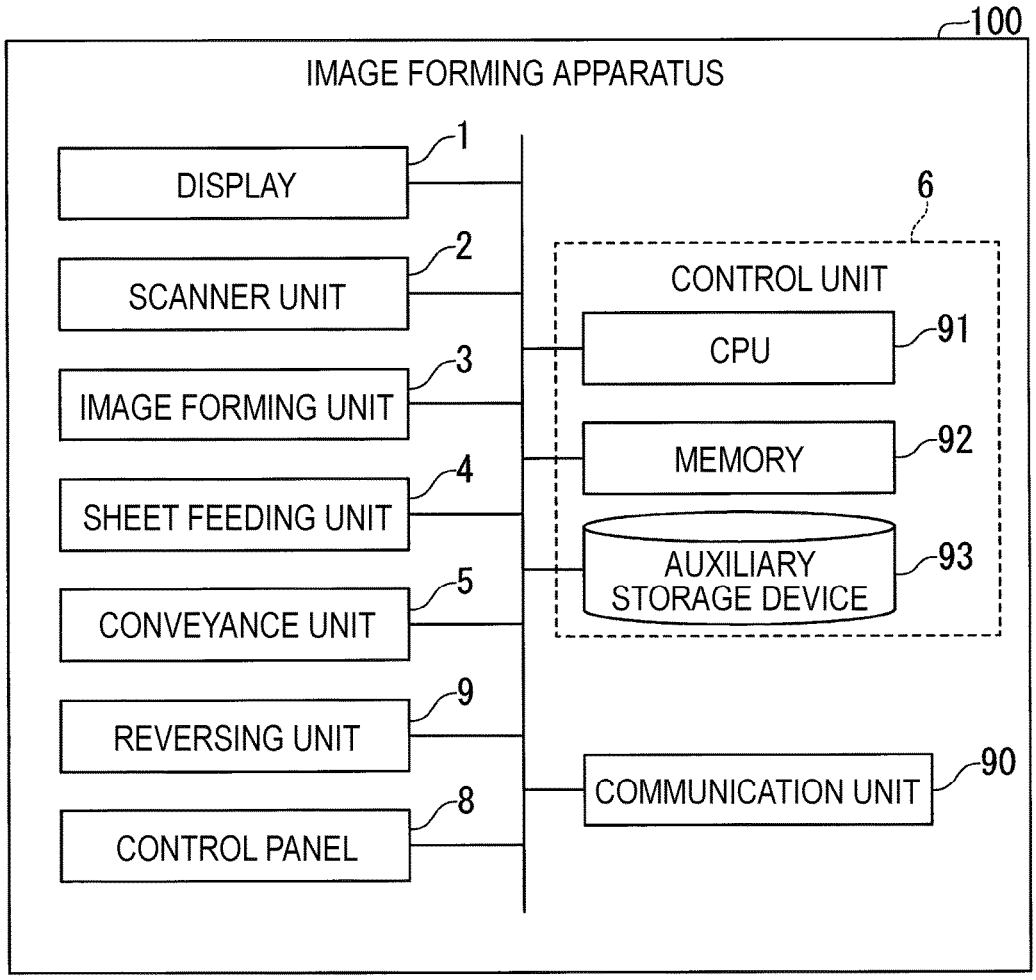
FIG. 2 depicts aspects of a hardware configuration of an image forming apparatus according to a first embodiment.

FIG. 2 is a diagram illustrating a specific example of a hardware configuration of the image forming apparatus 100 according to the first embodiment. The image forming apparatus 100 includes a central processing unit (CPU) 91, a memory 92, an auxiliary storage device 93, and the like connected by a bus, and executes a program. The image forming apparatus 100 functions as an apparatus including the scanner unit 2, the image forming unit 3, the sheet feeding unit 4, the conveyance unit 5, the reversing unit 9, the control panel 8, and a communication unit 90 by executing a program. In some examples, all or a part of each described function of the image forming apparatus 100 may be realized using dedicated hardware or the like such as an application specific integrated circuit (ASIC), a programmable logic device (PLD), and a field programmable gate array (FPGA). The program executed by CPU 91 may be recorded on a non-transitory computer-readable recording medium. The computer-readable recording medium can be, for example, a portable medium such as a flexible disk, a magneto-optical disk, a ROM, a CD-ROM, or a storage device such as a hard disk built in a computer system. The program may also be transmitted or downloaded via a telecommunication line.

The CPU 91 functions as the control unit 6 (also referred to as a controller 6) by executing a program stored in the memory 92 and/or the auxiliary storage device 93. The control unit 6 controls the operation of each functional unit of the image forming apparatus 100. The auxiliary storage device 93 can be a storage device such as a magnetic hard disk device or a semiconductor storage device (SSD). The auxiliary storage device 93 stores various information related to the image forming apparatus 100. The communication unit 90 includes a communication interface for connecting the own apparatus to an external device. The communication unit 90 communicates with an external device via the communication interface.

Figure 3:
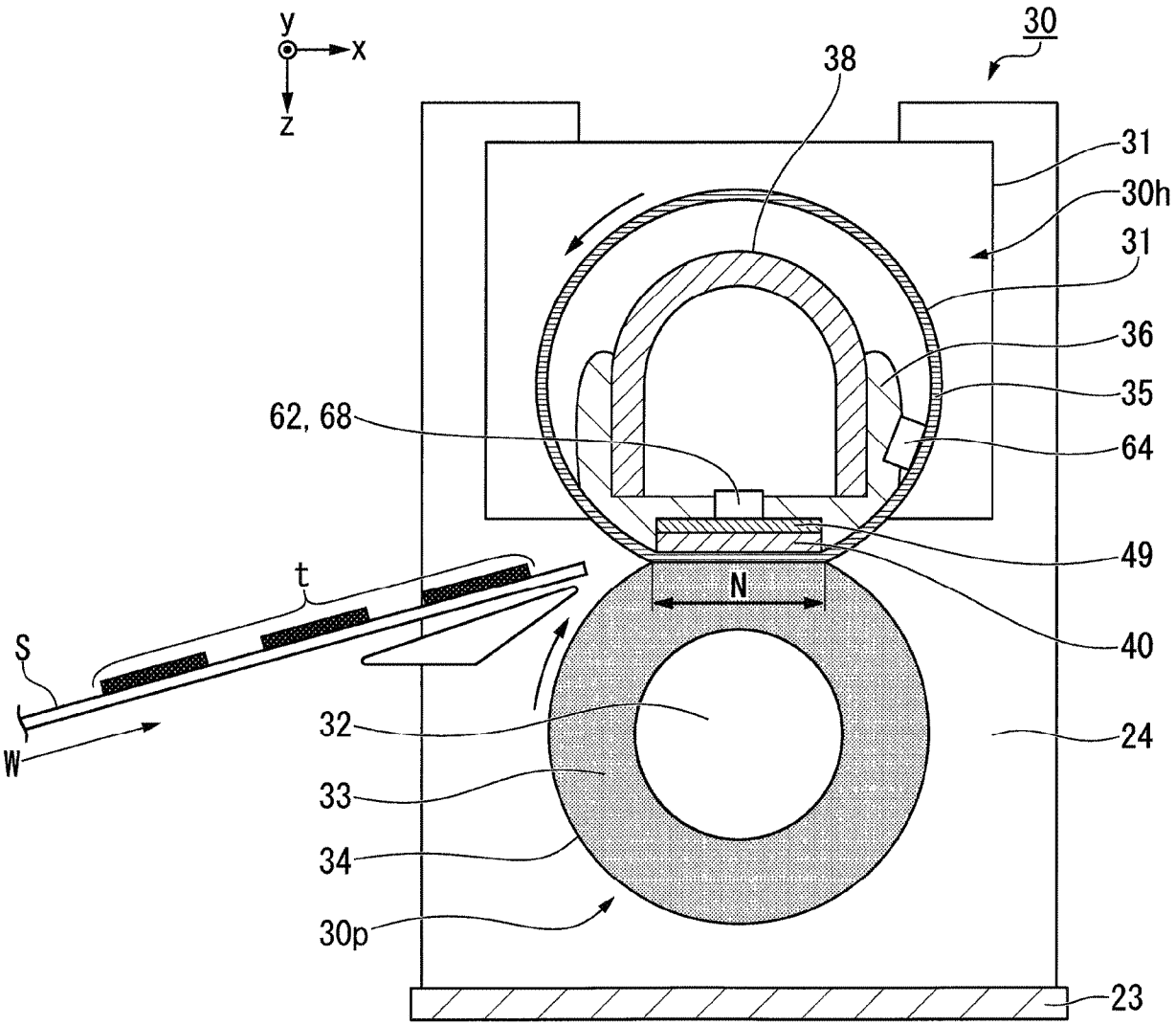
FIG. 3 is a cross-sectional view of a heating device according to a first embodiment.

FIG. 3 is a cross-sectional view of a heating device according to the first embodiment. The heating device according to the first embodiment is used as the fixing device 30. The fixing device 30 includes a pressing roller 30*p* and a film unit 30*h*.

The pressing roller 30*p* forms a nip N with the film unit 30*h*. The pressing roller 30*p* presses a toner image t on the sheet S that enters the nip N. The pressing roller 30*p* rotates and conveys the sheet S. The pressing roller 30*p* includes a core bar 32, an elastic layer 33, and a release layer 34. As described above, the pressing roller 30*p* can press the surface of the fixing film 35 and can be driven to rotate.

The core bar 32 is formed of a metal material such as stainless steel in a cylindrical shape. Both ends in the axial direction of the core bar 32 are rotatably supported. The core bar 32 is driven to rotate by a motor. The core bar 32 contacts a cam member. The movement of the cam member makes the core bar 32 approach or separate from the film unit 30*h*.

The elastic layer 33 is formed of an elastic material such as silicone rubber. The elastic layer 33 is formed with a certain thickness on the outer peripheral surface of the core bar 32. The release layer 34 is formed of a resin material such as PFA (tetrafluoroethylene/perfluoroalkyl vinyl ether copolymer). The release layer is formed on the outer peripheral surface of the elastic layer 33. The outer peripheral surface of the pressing roller 30*p* preferably has a hardness of 40° to 70° at a load of 9.8 N measured by an ASKER-C hardness meter. Thus, the area of the nip N and the durability of the pressing roller 30*p* are ensured.

The pressing roller 30*p* can approach and separate from the film unit 30*h* by rotation of the cam member. When the pressing roller 30*p* is brought close to the film unit 30*h* and pressed by a pressing spring, the nip N is formed. On the other hand, when the sheet S is jammed in the fixing device 30, the sheet S can be removed by separating the pressing roller 30*p* from the film unit 30*h*. Further, in a state where the rotation of the fixing film 35 is stopped, such as during sleep, the pressing roller 30*p* is separated from the film unit 30*h*, so that the plastic deformation of the fixing film 35 is prevented.

The pressing roller 30*p* is driven to rotate by a motor. When the pressing roller 30*p* rotates while the nip N is formed, the fixing film 35 of the film unit 30*h* is driven to rotate. The pressing roller 30*p* conveys the sheet S in the conveyance direction W by rotating while the sheet S is arranged in the nip N.

The film unit 30*h* heats the toner image t on the sheet S that enters the nip N. The film unit 30*h* includes the fixing film 35, a heater unit 40, a heat conducting member 49, a support member 36, a stay 38, a heater thermometer 62, a thermostat 68, and a film thermometer 64.

The fixing film 35 is formed in a cylindrical shape. The fixing film 35 includes a base layer, an elastic layer, and a release layer in this order from the inner peripheral side. The base layer is formed of a material such as nickel (Ni) in a cylindrical shape. The elastic layer is laminated on the outer peripheral surface of the base layer. The elastic layer is formed of an elastic material such as silicone rubber. The release layer is laminated on the outer peripheral surface of the elastic layer. The release layer is formed of a material such as PFA resin.

Figure 4:
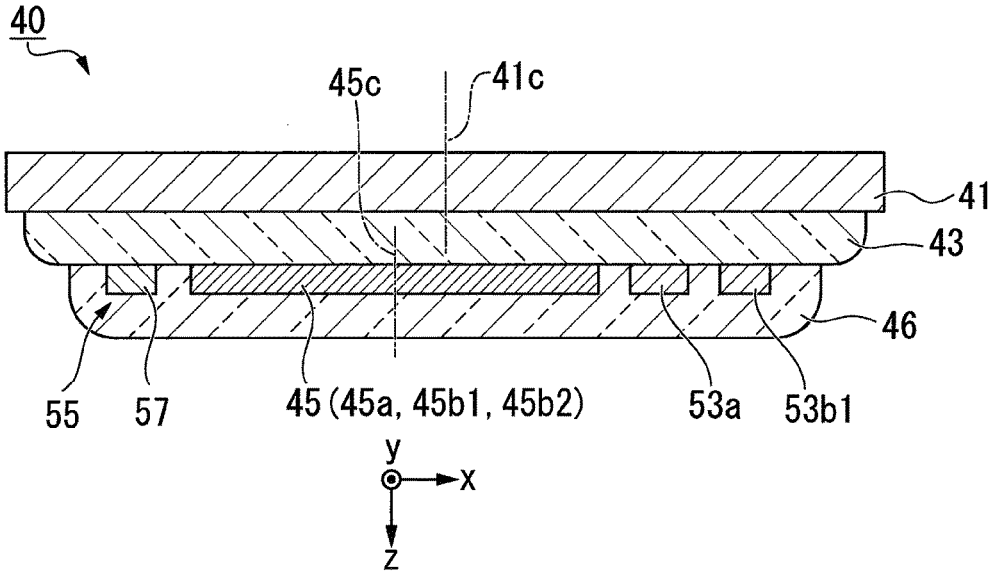
FIG. 4 is a cross-sectional view of a heater unit according to the first embodiment.
Figure 5:
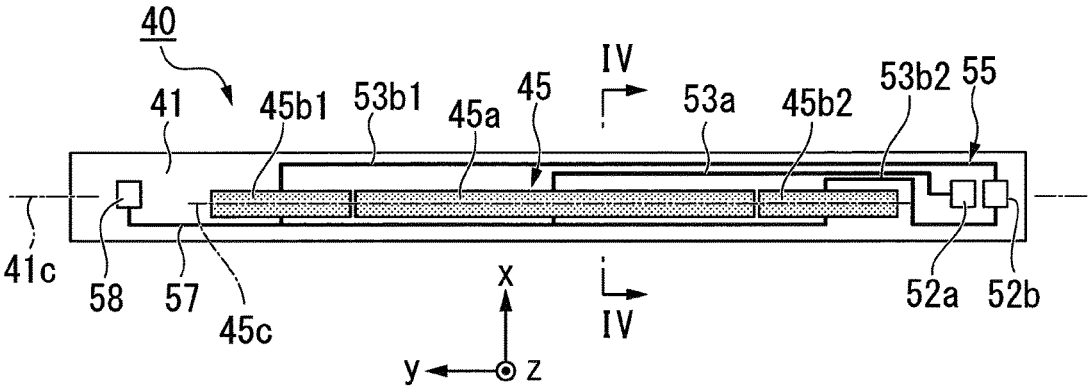
FIG. 5 is a bottom view of a heater unit according to a first embodiment.

FIG. 4 is a cross-sectional view of the heater unit taken along line IV-IV in FIG. 5. FIG. 5 is a bottom view (viewed towards the +z direction) of the heater unit. The heater unit 40 includes a substrate 41 (also referred to as heating element substrate 41), a heating element group 45, and a wiring group 55.

The substrate 41 is formed of a metal material such as stainless steel or a ceramic material such as aluminum nitride. The substrate 41 is formed in an elongated rectangular plate shape. The substrate 41 is arranged radially inside the fixing film 35. The longitudinal direction of the substrate 41 is the axial direction of the fixing film 35.

In the present application, the x, y, and z directions are defined as follows. The y direction is the longitudinal (long dimension) direction of the substrate 41. The y direction is parallel to the width direction of the fixing film 35. As described later, the +y direction is a direction along the y direction from a central heating element 45*a* to a first end heating element 45*b*1. The x direction is the short dimension direction of the substrate 41, and the +x direction corresponds to the conveyance direction (downstream direction) for the sheet S. The z direction is normal of the plane of the substrate 41, and the +z direction is the direction in which the heating element group 45 is arranged with respect to the substrate 41. On the surface of the substrate 41 to the +z direction side, an insulating layer 43 formed of a glass material or the like is formed.

The heating element group 45 is arranged on the substrate 41. The heating element group 45 is formed on the surface of the insulating layer 43 to the +z direction side, as shown in FIG. 4. The heating element group 45 is formed of a so called, "TCR" material, where TCR material stands temperature coefficient of resistance material. For example, the heating element group 45 is formed of a silver-palladium alloy or the like. The outer shape of the heating element group 45 is formed in a rectangular shape with the longitudinal direction along the y direction and the short direction along the x direction.

As shown in FIG. 5, the heating element group 45 includes the first end heating element 45*b*1, the central heating element 45*a*, and a second end heating element 45*b*2, which are arranged side by side in the y direction. The central heating element 45*a* is arranged at the center of the heating element group 45 in the y direction. The central heating element 45*a* may be configured by combining a plurality of small heating elements arranged side by side in the y direction. The first end heating element 45*b*1 is located at the end of the heating element group 45 in the +y direction, which is in the +y direction of the central heating element 45*a*. The second end heating element 45*b*2 is located at the end of the heating element group 45 in the −y direction, which is in the −y direction of the central heating element 45*a*. The boundary between the central heating element 45*a* and the first end heating element 45*b*1 may be arranged parallel to the x direction or may be arranged to intersect the x direction. The same applies to the boundary between the central heating element 45*a* and the second end heating element 45*b*2.

The heating element group 45 generates heat when energized. The electric resistance of the central heating element 45*a* is smaller than the electric resistance of the first end heating element 45*b*1 and the second end heating element 45*b*2. The sheet S having a small width in the y direction passes through the central portion of the fixing device 30 in the y direction. In this case, the control unit 6 causes only the central heating element 45*a* to generate heat. On the other hand, when the width of the sheet S in the y direction is large, the control unit 6 causes the entire heating element group 45 to generate heat. Therefore, the central heating element 45*a*, and the first end heating element 45*b*1 and the second end heating element 45*b*2 control the heat generation independently of each other. The heat generation of the first end heating element 45*b*1 and the second end heating element 45*b*2 are controlled similarly.

The wiring group 55 is formed of a metal material such as silver. The wiring group 55 includes a central contact 52*a*, a central wiring 53*a*, an end contact 52*b*, a first end wiring 53*b*1, a second end wiring 53*b*2, a common contact 58, and a common wiring 57.

The central contact 52*a* is arranged in the −y direction of the heating element group 45. The central wiring 53*a* is offset in the +x direction from the heating element group 45. The central wiring 53*a* connects the +x direction end of the central heating element 45*a* to the central contact 52*a*.

The end contact 52*b* is offset in the −y direction from the central contact 52*a*. The first end wiring 53*b*1 is offset in the +x direction from the heating element group 45 and the central wiring 53*a*. The first end wiring 53*b*1 connects the +x direction end of the first end heating element 45*b*1 to the +x direction end of the end contact 52*b*. The second end wiring 53*b*2 is offset in the +x direction from the heating element group 45 and in the −x direction from the central wiring 53*a*. The second end wiring 53*b*2 connects the +x direction end of the second end heating element 45*b*2 and the −x direction end of the end contact 52*b*.

The common contact 58 is offset in the +y direction from the heating element group 45. The common wiring 57 is offset in the −x direction from the heating element group 45. The common wiring 57 connects the −x direction ends of the central heating element 45*a*, the first end heating element 45*b*1, and the second end heating element 45*b*2 to the common contact 58.

Thus, the second end wiring 53*b*2, the central wiring 53*a*, and the first end wiring 53*b*1 are offset in the +x direction from the heating element group 45. Only the common wiring 57 is offset in the −x direction from the heating element group 45. Therefore, the center 45*c* of the heating element group 45 along the x direction is offset in the −x direction from the center 41*c* of the substrate 41 along the x direction.

As shown in FIG. 3, if a straight line was drawn connecting the center of the pressing roller 30*p* and the center of the film unit 30*h*, the center 41*c* (see FIG. 4) along the x direction of the substrate 41 would be offset in the +x direction from the straight line. As a result, the substrate 41 extends beyond the nip N in the +x direction, and a sheet S that passes through the nip N is more easily separated from the film unit 30*h*.

The center 45*c* (see FIG. 4) of the heating element group 45 along the x direction is arranged to be on the straight line connecting the centers of the pressing roller 30*p* and the film unit 30*h*. The heating element group 45 is centered on the nip N and is entirely included within the area covered by the nip N (that is, the heating element group 45 does not extend in either the +x direction or −x direction beyond the outer dimensions of the nip N. Thereby, the heat distribution of the nip N is uniform, and the sheet S passing through the nip N is evenly heated.

As shown in FIG. 4, the heating element group 45 and the wiring group 55 are formed on the surface of the insulating layer 43 to the +z direction side. A protective layer 46 is formed of a glass material or the like so as to cover the heating element group 45 and the wiring group 55. The protective layer 46 reduces friction (improves the slidability) between the heater unit 40 and the fixing film 35.

As shown in FIG. 3, the heater unit 40 is arranged inside the fixing film 35. A lubricant can be applied to the inner peripheral surface of the fixing film 35. The heater unit 40 contacts the inner peripheral surface of the fixing film 35 via the lubricant. When the heater unit 40 generates heat, the viscosity of the lubricant decreases. Thereby, the friction between the heater unit 40 and the fixing film 35 is reduced.

As described above, the fixing film 35 is a strip-shaped thin film having a surface that contacts and slides on the surface of the heater unit 40.

The heat conducting member 49 is formed of a metal material having a high thermal conductivity such as copper. The outer shape of the heat conducting member 49 is corresponds to the outer shape of the substrate 41 of the heater unit 40. The heat conducting member 49 is arranged to be in contact with the −z direction facing surface of the heater unit 40.

The support member 36 is formed of a resin material such as a liquid crystal polymer. The support member 36 is arranged to cover the −z direction side of the heater unit 40 and both x-direction sides/ends of the heater unit 40. The support member 36 supports the heater unit 40 via the heat conducting member 49. Chamfers or edge roundings are formed on both ends in the x direction of the support member 36. The support member 36 supports the inner peripheral surface of the fixing film 35 at both ends in the x direction of the heater unit 40.

When the sheet S passing through the fixing device 30 is heated, a temperature distribution occurs in the heater unit 40 according to the size of the sheet S. If the temperature of the heater unit 40 becomes locally high, the temperature may exceed the heat-resistant temperature of the support member 36 formed of a resin material. The heat conducting member 49 averages the temperature distribution of the heater unit 40. Thereby, the heat resistance of the support member 36 is ensured.

Figure 6:
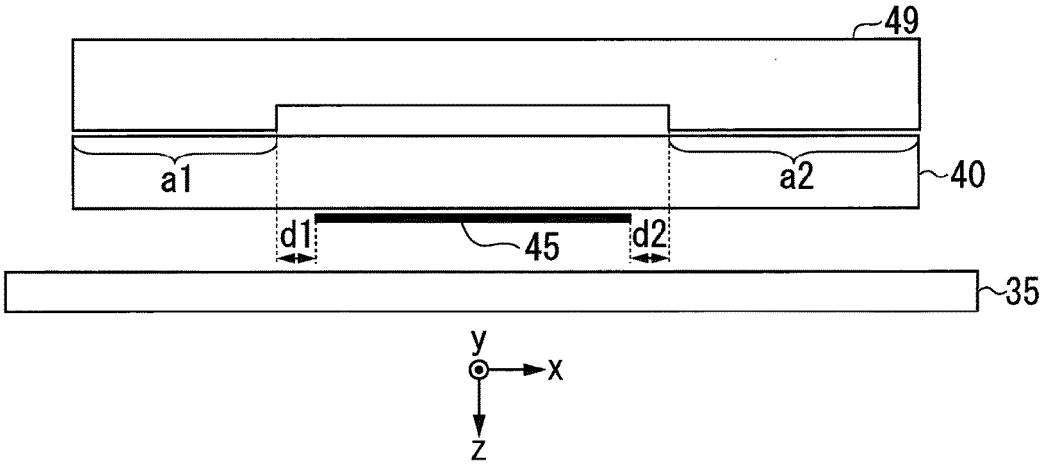
FIG. 6 is a cross-sectional view of a heat conducting member, a heater unit, and a tubular belt according to a first embodiment.

FIG. 6 is a cross-sectional view of the heat conducting member, the heater unit, and the tubular belt. The heat conducting member 49 is arranged on the surface of the heater unit 40 that does not contact the fixing film 35. Further, the heat conducting member 49 is configured so as not to contact the heater unit 40 at a position where the heat generation distribution in the heater unit 40 becomes a peak. Specifically, as shown in FIG. 6, the heater unit 40 and the heat conducting member 49 are in contact with each other in areas a1 and a2. The non-contact portion forms a groove of the heat conducting member 49. The width of the groove is set wider than the width of the heating element group 45 of the heater unit 40 by the length d1 and the length d2, respectively. For example, the width of the heating element group 45 of the heater unit 40 is 4.5 to 4.9 mm, and the width of the groove is about 5 mm.

The stay 38 shown in FIG. 3 is formed of a steel plate material or the like. The cross section of the stay 38 perpendicular to the y direction is formed in a U-shape. The stay 38 is mounted to the −z direction facing side of the support member 36 so as to close the U-shaped opening with the support member 36. The stay 38 extends in the y direction and both ends of the stay 38 in the y direction are fixed to the housing of the image forming apparatus 100. As a result, the film unit 30*h* is supported by the image forming apparatus 100. The stay 38 improves the rigidity of the film unit 30*h* and limits bending or flexing. Flanges 31 for restricting the movement of the fixing film 35 in the y direction are mounted near both ends of the stay 38 in the y direction.

The heater thermometer 62 is arranged in the −z direction of the heater unit 40 with the heat conducting member 49 interposed therebetween. For example, the heater thermometer 62 is a thermistor. The heater thermometer 62 is mounted and supported on a −z direction facing surface of the support member 36. The temperature sensing element of the heater thermometer 62 contacts the heat conducting member 49 through a hole penetrating the support member 36 in the z direction. The heater thermometer 62 measures the temperature of the heater unit 40 via the heat conducting member 49.

The thermostat 68 is arranged similarly to the heater thermometer 62. The thermostat 68 is incorporated in an electric circuit described later. The thermostat 68 cuts off power supply to the heating element group 45 when the temperature of the heater unit 40 detected via the heat conducting member 49 exceeds a predetermined temperature.

Figure 7:
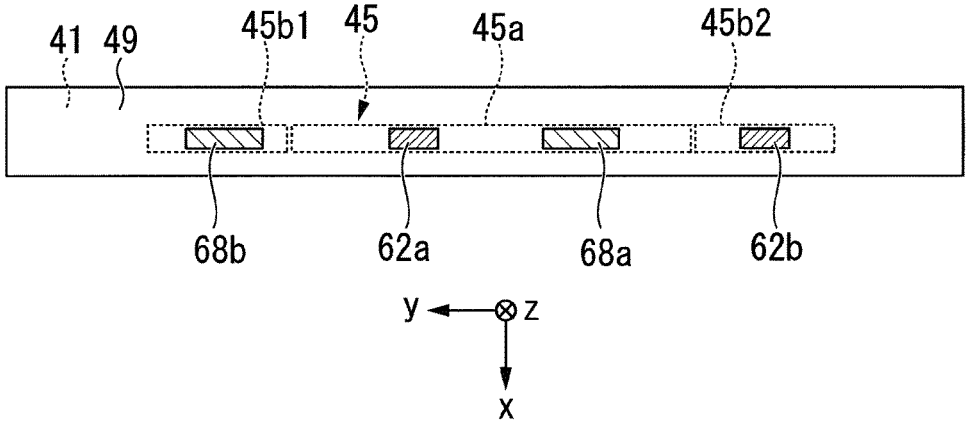
FIG. 7 is a plan view of a heater thermometer and a thermostat according to a first embodiment.

FIG. 7 is a plan view (viewed from the −z direction side) of the heater thermometer and the thermostat. In FIG. 7, the illustration of the support member 36 is omitted. The following description regarding the arrangement of the heater thermometer 62, the thermostat 68, and the film thermometer 64 describes the arrangement of the respective temperature sensing elements.

A plurality of heater thermometers 62 (a central heater thermometer 62*a* and an end heater thermometer 62*b*) are arranged side by side along the y direction. The plurality of heater thermometers 62 are arranged within the range covered by the heating element group 45 along the y direction. The plurality of heater thermometers 62 are arranged at the center of the heating element group 45 along the x direction. That is, when viewed from the z direction, the plurality of heater thermometers 62 and the heating element group 45 overlap at least in part. A plurality of thermostats 68 (including a central thermostat 68*a* and an end thermostat 68*b*) are also arranged in the same manner as the plurality of heater thermometers 62 described above.

The plurality of heater thermometers 62 includes the central heater thermometer 62*a* and the end heater thermometer 62*b*. The central heater thermometer 62*a* measures the temperature of the central heating element 45*a*. The central heater thermometer 62*a* is arranged within the range covered by the central heating element 45*a*. That is, when viewed from the z direction, the central heater thermometer 62*a* and the central heating element 45*a* overlap.

The end heater thermometer 62*b* measures the temperature of the second end heating element 45*b*2. As described above, the heat generation of the first end heating element 45*b*1 and the second end heating element 45*b*2 is similarly controlled. Therefore, the temperature of the first end heating element 45*b*1 is equal to the temperature of the second end heating element 45*b*2. The end heater thermometer 62*b* is arranged within the range covered by the second end heating element 45*b*2. That is, when viewed from the z direction, the end heater thermometer 62*b* and the second end heating element 45*b*2 overlap.

The plurality of thermostats 68 include the central thermostat 68*a* and the end thermostat 68*b*. The central thermostat 68*a* cuts off power supply to the heating element group 45 when the temperature of the central heating element 45*a* exceeds a predetermined temperature. The central thermostat 68*a* is arranged within the range covered by the central heating element 45*a*. That is, when viewed from the z direction, the central thermostat 68*a* and the central heating element 45*a* overlap.

The end thermostat 68*b* cuts off power supply to the heating element group 45 when the temperature of the first end heating element 45*b*1 exceeds a predetermined temperature. As described above, the heat generation of the first end heating element 45*b*1 and the second end heating element 45*b*2 is similarly controlled. Therefore, the temperature of the first end heating element 45*b*1 is equal to the temperature of the second end heating element 45*b*2. The end thermostat 68*b* is arranged within the range covered by the first end heating element 45*b*1. That is, when viewed from the z direction, the end thermostat 68*b* and the first end heating element 45*b*1 overlap.

As described above, the central heater thermometer 62*a* and the central thermostat 68*a* are arranged within the range covered by the central heating element 45*a*. Thus, the temperature of the central heating element 45*a* is measured. When the temperature of the central heating element 45*a* exceeds a predetermined temperature, the power supply to the heating element group 45 is cut off. On the other hand, the end heater thermometer 62*b* and the end thermostat 68*b* are arranged within the range covered by the first end heating element 45*b*1 and the second end heating element 45*b*2. Thus, the temperatures of the first end heating element 45*b*1 and the second end heating element 45*b*2 are measured. When the temperatures of the first end heating element 45*b*1 and the second end heating element 45*b*2 exceed a predetermined temperature, the power supply to the heating element group 45 is cut off.

The plurality of heater thermometers 62 and the plurality of thermostats 68 are arranged alternately along the y direction. As described above, the first end heating element 45*b*1 is arranged to the +y direction side of the central heating element 45*a*. The end thermostat 68*b* is arranged within the range covered by the first end heating element 45*b*1. The central heater thermometer 62*a* is offset to the +y direction side from the center of the central heating element 45*a* in the y direction. The central thermostat 68*a* is offset to the −y direction side from the center of the central heating element 45*a* in the y direction. As described above, the second end heating element 45*b*2 is offset to the −y direction side of the central heating element 45*a*. The end heater thermometer 62*b* is arranged within the range covered by the second end heating element 45*b*2. Thus, from the +y direction to the −y direction, the end thermostat 68*b*, the central heater thermometer 62*a*, the central thermostat 68*a*, and the end heater thermometer 62*b* are arranged side by side in this order.

In general, the thermostat 68 connects and disconnects the electric circuit by using a bending deformation of a bimetal accompanying a temperature change. The thermostat is formed long and thin according to the shape of the bimetal. The terminals extend outward from both ends of the thermostat 68 in the longitudinal direction. An external wiring connector is connected to this terminal by caulking. Therefore, it is necessary to secure a space outside the thermostat 68 in the longitudinal direction. In the fixing device 30, since there is no space in the x direction, the longitudinal direction of the thermostat 68 is arranged along the y direction. If a plurality of thermostats 68 are arranged adjacent to each other along the y direction, it becomes difficult to secure a connection space for external wiring.

As described above, the plurality of heater thermometers 62 and the plurality of thermostats 68 are arranged alternately side by side along the y direction. Thus, a heater thermometer 62 is arranged next to a thermostat 68 in the y direction. Therefore, a space for connecting the external wiring to the thermostat 68 can be secured. Furthermore, the degree of freedom of the layout of the thermostat 68 and the heater thermometer 62 in the y direction is increased. Thereby, the thermostat 68 and the heater thermometer 62 can be arranged at the optimum positions to control the temperature of the fixing device 30. Furthermore, a separation between the AC wiring connected to the plurality of thermostats 68 and the DC wiring connected to the plurality of heater thermometers 62 is facilitated. Therefore, the generation of noise in the electric circuit is suppressed.

The film thermometer 64 is disposed inside the region surrounded by the fixing film 35 and offset to the +x direction from the heater unit 40, as shown in FIG. 3. The film thermometer 64 contacts the inner peripheral surface of the fixing film 35 and measures the temperature of the fixing film 35. Hereinafter, the detected temperature of the film thermometer 64 is referred to as "first detected temperature".

Figure 8:
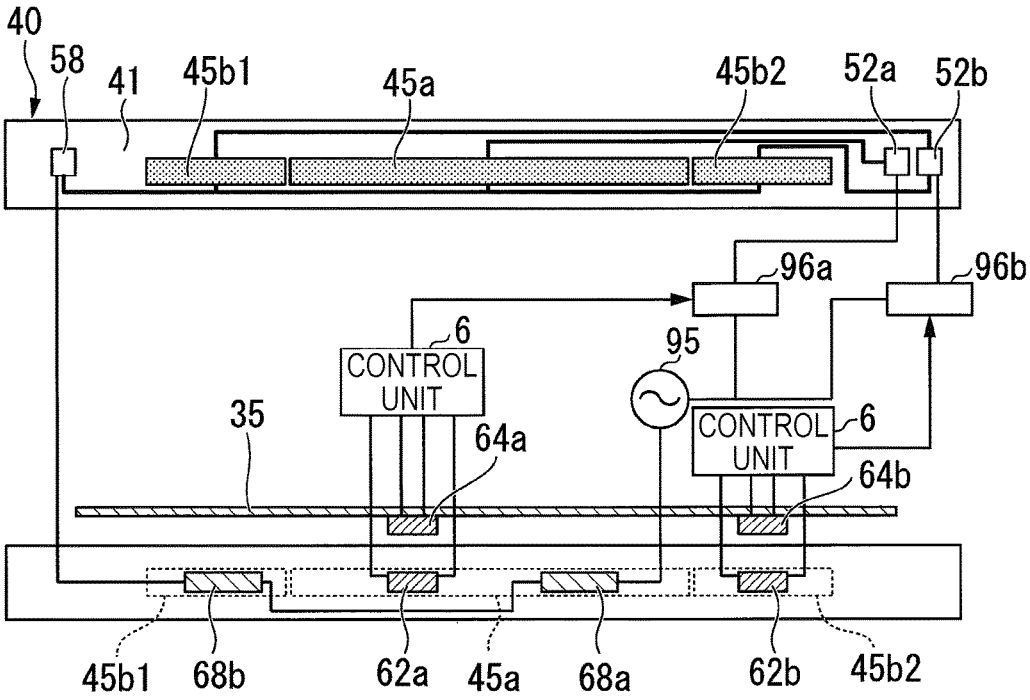
FIG. 8 is an electric circuit diagram of a heating device according to a first embodiment.

FIG. 8 is an electric circuit diagram of the heating device according to the first embodiment. In FIG. 8, the bottom view of FIG. 5 is arranged on the upper side on the plane of the paper, and the plan view of FIG. 8 is arranged on the lower side of the plane of the paper. In FIG. 8, the plurality of film thermometers 64 are shown together with the cross section of the fixing film 35 above the lower plan view. The plurality of film thermometers include a central film thermometer 64*a* and an end film thermometer 64*b*.

The central film thermometer 64*a* contacts the central portion of the fixing film 35 in they direction. The central film thermometer 64*a* contacts the fixing film 35 within the range covered by the central heating element 45*a* along the y direction. The central film thermometer 64*a* measures the temperature of the central portion of the fixing film 35.

The end film thermometer 64*b* contacts the −y direction end of the fixing film 35. The end film thermometer 64*b* contacts the fixing film 35 within the range covered by the second end heating element 45*b*2 in the y direction. The end film thermometer 64*b* measures the temperature of the −y direction end of the fixing film 35. The heat generation of the first end heating element 45*b*1 and the second end heating element 45*b*2 is similarly controlled. Therefore, the temperature at the −y direction end of the fixing film 35 will be substantially equal to the temperature at the +y direction end thereof.

A power supply 95 is connected to the central contact 52*a* via a central triac 96*a*. The power supply 95 is connected to the end contact 52*b* via an end triac 96*b*. The control unit 6 controls ON and OFF of the central triac 96*a* and the end triac 96*b* independently of each other.

When the control unit 6 turns on the central triac 96*a*, power is supplied from the power supply 95 to the central heating element 45*a*. As a result, the central heating element 45*a* generates heat. When the control unit 6 turns on the end triac 96*b*, power is supplied from the power supply 95 to the first end heating element 45*b*1 and the second end heating element 45*b*2. Thus, the first end heating element 45*b*1 and the second end heating element 45*b*2 generate heat. As described above, the central heating element 45*a*, and the first end heating element 45*b*1 and the second end heating element 45*b*2 control independently the heat generation of each other. The central heating element 45*a*, the first end heating element 45*b*1, and the second end heating element 45*b*2 are connected in parallel to the power supply 95.

The power supply 95 is connected to the common contact 58 via the central thermostat 68*a* and the end thermostat 68*b*. The central thermostat 68*a* and the end thermostat 68*b* are connected in series. When the temperature of the central heating element 45*a* rises abnormally, the detected temperature of the central thermostat 68*a* exceeds a predetermined temperature. At this time, the central thermostat 68*a* cuts off power supply from the power supply 95 to the entire heating element group 45.

When the temperature of the first end heating element 45*b*1 rises abnormally, the detected temperature of the end thermostat 68*b* exceeds a predetermined temperature. At this time, the end thermostat 68*b* cuts off power supply from the power supply 95 to the entire heating element group 45. As described above, the heat generation of the first end heating element 45*b*1 and the second end heating element 45*b*2 is similarly controlled. Therefore, when the temperature of the second end heating element 45*b*2 abnormally rises, the temperature of the first end heating element 45*b*1 also rises. Therefore, similarly, when the temperature of the second end heating element 45*b*2 abnormally rises, the end thermostat 68*b* cuts off power supply from the power supply 95 to the entire heating element group 45.

The control unit 6 measures the temperature of the central heating element 45*a* with the central heater thermometer 62*a*. The control unit 6 measures the temperature of the second end heating element 45*b*2 with the end heater thermometer 62*b*. The temperature of the second end heating element 45*b*2 is equal to the temperature of the first end heating element 45*b*1. The control unit 6 measures the temperature of the heating element group 45 with the heater thermometer 62 when the fixing device 30 is started (at the time of warming-up) and when the fixing device 30 is returned from a temporary halt state (sleep state).

When the fixing device 30 is started and is returned from the temporary halt state, the control unit 6 causes the heating element group 45 to generate heat for a short time when the temperature of at least one of the central heating element 45*a* and the second end heating element 45*b*2 is lower than a predetermined temperature. Thereafter, the control unit 6 starts the rotation of the pressing roller 30*p*. Due to the heat generated by the heating element group 45, the viscosity of the lubricant applied to the inner peripheral surface of the fixing film 35 decreases. Thereby, the static friction between the heater unit 40 and the fixing film 35 at the start of the rotation of the pressing roller 30*p* is reduced.

The control unit 6 measures the temperature of the central portion of the fixing film 35 along the y direction by the central film thermometer 64*a*. The control unit 6 measures the temperature at the −y direction end of the fixing film 35 with the end film thermometer 64*b*. The temperature of the −y direction end of the fixing film 35 is substantially equal to the temperature of the +y direction end of the fixing film 35. The control unit 6 measures the temperature of the central portion and the end of the fixing film 35 along the y direction during the operation of the fixing device 30.

The control unit 6 controls the phase or the frequency of the electric power supplied to the heating element group 45 with the central triac 96*a* and the end triac 96*b*. The control unit 6 controls the power supply to the central heating element 45*a* based on the temperature measurement result of the central portion of the fixing film 35. The control unit 6 controls the power supply to the first end heating element 45*b*1 and the second end heating element 45*b*2 based on the temperature measurement result of the end of the fixing film 35.

Figure 9A:
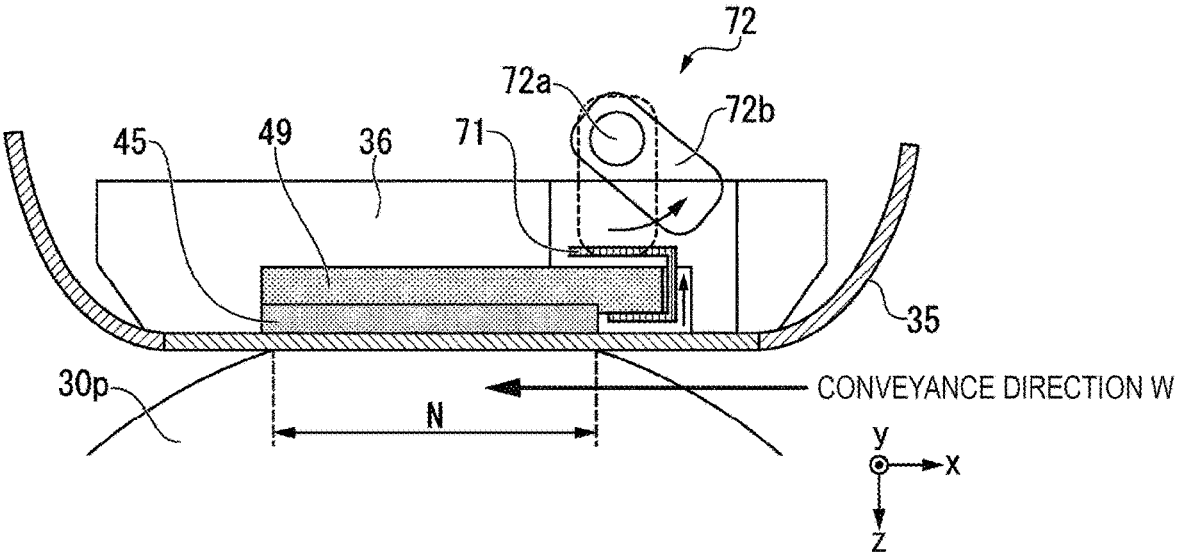
FIGS. 9A and 9B are diagrams depicting particular aspects of a fixing device according to a first embodiment.
Figure 9B:
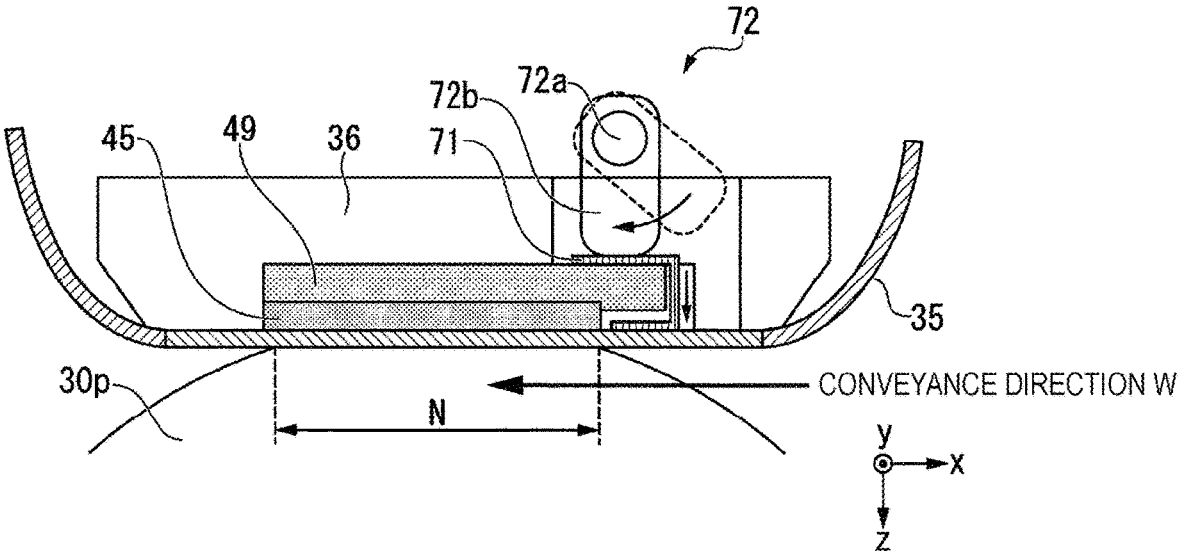

FIGS. 9A and 9B are diagrams illustrating a configuration example of a fixing device according to the first embodiment. The fixing device 30 according to the first embodiment includes a second heat conducting member 71 and a drive unit 72 for controlling the position of the second heat conducting member 71. These aspects are in addition to the heat conducting member 49 described above. Hereinafter, the heat conducting member 49 will be referred to as a first heat conducting member 49 in order to distinguish the heat conducting member 49 from the second heat conducting member 71.

For example, the second heat conducting member 71 is configured using a channel-shaped member having a U-shaped cross section perpendicular to the longitudinal direction (length along the y direction). The second heat conducting member 71 is positioned so as to wrap around one edge (the +x direction end in figures) of the first heat conducting member 49 inside the U-shape. In order to permit such a configuration, the first heat conducting member 49 extends beyond the heater unit 40 in the +x direction. In this case, the width of the nip N is still approximately equal to or less than the width of the heater unit 40, and set so this does not hinder the contact between the first heat conducting member 49 with the fixing film 35. The second heat conducting member 71 is controlled (moved) by the drive unit 72 to be in a first state (shown in FIG. 9A) or a second state (shown in FIG. 9B).

In the first state the second heat conducting member 71 is in contact with the first heat conducting member 49 at the inner surface of the lower branch of the U-shape (that is, the +z direction facing surface of the bottom arm of the U-shape contacts a −z direction facing surface of the first heat conducting member 49). In the second state the second heat conducting member 71 contacts the fixing film 35 at the outer surface of the lower branch of the U-shape (that is, the −z direction facing surface of the bottom arm of the U-shape contacts the inside facing surface of the fixing film 35) and the first heat conducting member 49 at the inner surface of the upper branch of the U shape (that is, the −z direction facing surface of the upper arm of the U-shape contact the +z direction facing surface of the first heat conducting member 49). In the second state, the second heat conducting member 71 is positioned so as to contact the fixing film 35 on the upstream side of the nip N with respect to the sheet conveyance direction W. The second heat conducting member 71 is arranged so as not to contact the heater unit 40.

In FIGS. 9A and 9B, the inner surface of the bottom portion of the U-shape of the second heat conducting member 71 is arranged so as not to contact the side surface of the first heat conducting member 49, but this depiction is one example. In other examples, the second heat conducting member 71 may be arranged such that the inner surface of the bottom portion of the U-shape contacts the first heat conducting member 49 as long as the vertical movement (state change) of the second heat conducting member 71 is not hindered.

The drive unit 72 is configured using, for example, a rotation shaft 72*a* and a rotating body 72*b* fixed to the rotation shaft 72*a* and thus rotating with the rotation shaft 72*a*. For example, the rotation shaft 72*a* is connected to a rotating drive unit such as a motor, and rotates around an axis parallel to the y-axis, as a rotation shaft. For example, the driving of the motor can be controlled by the control unit 6. The drive unit 72 controls the second heat conducting member 71 to be in either the first state or the second state by rotating the rotating body 72*b* with the rotation shaft 72*a* and changing the position thereof.

For example, in the first state, the drive unit 72 is controlled such that the rotating body 72*b* is at a position where the rotating body 72*b* does not contact the second heat conducting member 71. In this case, the second heat conducting member 71 is controlled to the first state by being pushed up in the −z direction by a spring member or the like. On the other hand, in the second state, the drive unit 72 is controlled such that the rotating body 72*b* is at a position where the second heat conducting member 71 is pushed in the +z direction.

Such a configuration is an example of a method of controlling the second heat conducting member 71 to be in the first state or the second state. The control of the state of the second heat conducting member 71 may be realized by any other method as long as the position of the second heat conducting member 71 can be controlled to the first state or the second state. For example, the drive unit 72 may include a mechanism that converts the rotational motion of the motor into a reciprocating linear motion, and may change the position of the second heat conducting member 71 by the reciprocating linear motion along the z-axis direction.

The fixing device 30 configured as described above has a second heat transfer path in addition to a first heat transfer path that directly transfers the heat generated in the heater unit 40 to the fixing film 35. The second heat transfer path transfers heat generated in the heater unit 40 to the fixing film 35 via the second heat conducting member 71. Thus, the fixing device 30 can supply the heat generated in the heater unit 40 to the fixing film 35 via the second heat transfer path as needed. Therefore, the time required for heating the fixing film 35 can be reduced.

Figure 10:
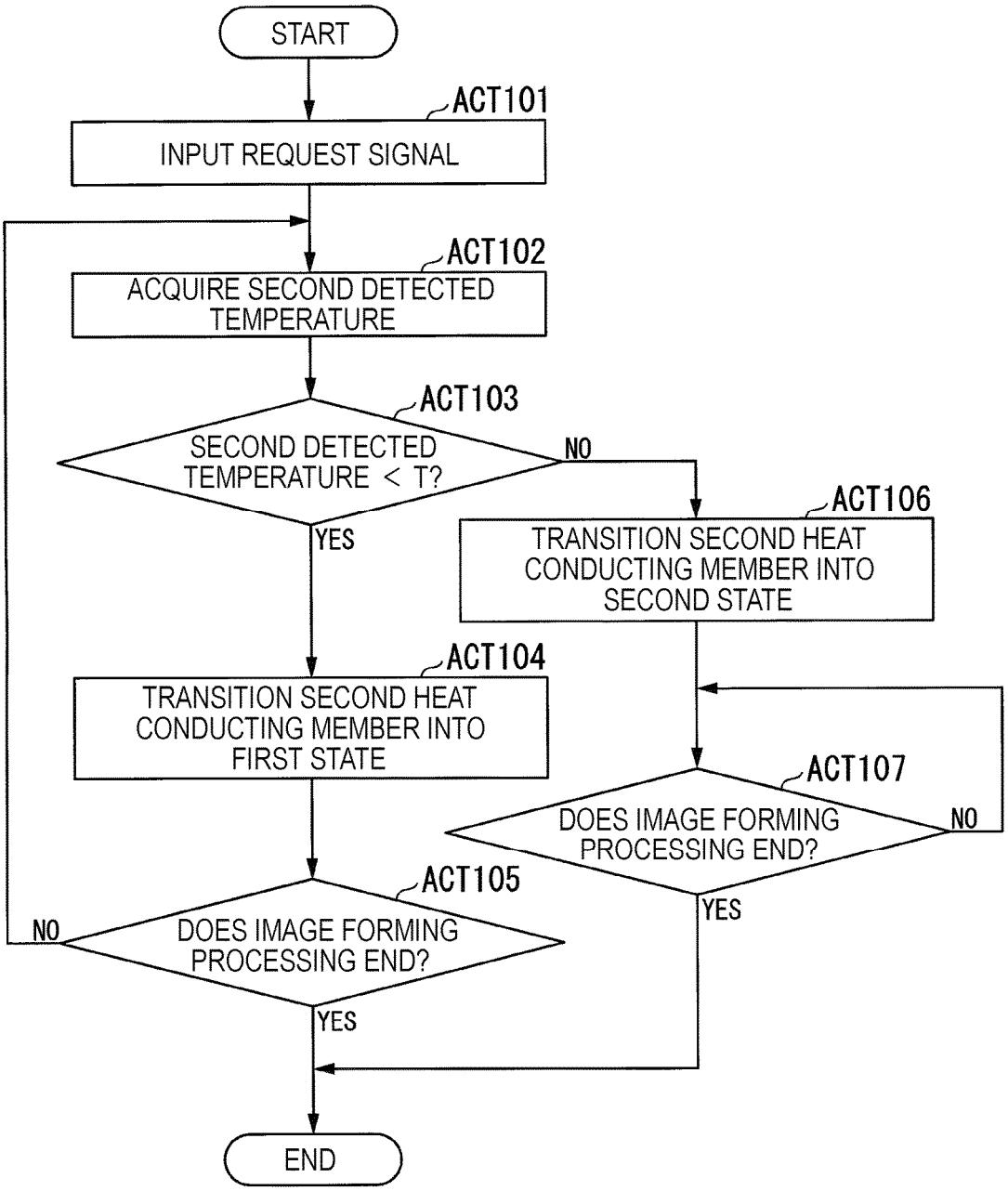
FIG. 10 is a flowchart depicting aspects of state control processing according to a first embodiment.

FIG. 10 is a flowchart showing a flow of a process of controlling the second heat conducting member 71 to be in the first state or the second state (hereinafter, referred to as "state control processing") according to the first embodiment. First, the control unit 6 inputs a request signal for requesting that the image forming apparatus 100 execute image forming processing (ACT 101). This request signal may be received from another communication device via the communication unit 90, or may be input by user operation of the control panel 8. In response to the input of the request signal, the image forming apparatus 100 starts the image forming processing with the setting(s) provided by the request signal.

Subsequently, the control unit 6 acquires the detected temperature of the heater thermometer 62 (hereinafter, referred to as "second detected temperature") (ACT 102). The control unit 6 determines whether or not the second detected temperature is lower than a threshold T (ACT 103). If the second detected temperature is lower than threshold T (YES in ACT 103), the control unit 6 causes the second heat conducting member 71 to transition to the first state (ACT 104). For example, the control unit 6 causes the second heat conducting member 71 to transition from the state of FIG. 9B to the state of FIG. 9A. When the second heat conducting member 71 is already in the first state, ACT 104 may be omitted.

After the transition of the second heat conducting member 71 to the first state, the control unit 6 subsequently determines whether or not the image forming processing started according to ACT 101 is completed (ACT 105). If the image forming processing is not yet completed (NO in ACT 105), the control unit 6 returns the process to ACT 102. On the other hand, if the image forming processing is completed (YES in ACT 105), the control unit 6 ends the state control processing of the second heat conducting member 71.

If the second detected temperature is equal to or higher than the threshold T (NO in ACT 103), the control unit 6 causes the second heat conducting member 71 to transition to the second state (ACT 106). For example, the control unit 6 causes the second heat conducting member 71 to transition from the state of FIG. 9A to the state of FIG. 9B. When the second heat conducting member 71 is already in the second state, ACT 105 may be omitted.

After the transition of the second heat conducting member 71 to the second state, the control unit 6 subsequently determines whether or not the image forming processing started according to ACT 101 has been completed (ACT 107). If the image forming processing is not yet completed (No in ACT 107), the control unit 6 repeatedly executes ACT 107. On the other hand, when the image forming processing is completed (YES in ACT 107), the control unit 6 ends the state control processing of the second heat conducting member 71.

In the state control processing of the second heat conducting member 71 described above, the threshold T is set to an operating temperature on the upstream side of the nip N of the fixing film 35 or a temperature higher than the operating temperature. For example, the threshold T can be set to about 140° C. By setting the threshold T to such a value, the second heat conducting member 71 can be separated from the fixing film 35 when the second heat conducting member 71 is not sufficiently heated. Therefore, in this case, if the fixing film 35 is suitably heated, it is possible to suppress the heat of the fixing film 35 from being taken away by the second heat conducting member 71.

On the other hand, by setting the threshold T to such a value, the second heat conducting member 71 can be in contact with the fixing film 35 when the second heat conducting member 71 is sufficiently heated. Therefore, in this case, the heat of the first heat conducting member 49 can be used for heating the fixing film 35, and the time required for heating the fixing film 35 can be reduced. In order to heat the fixing film 35 efficiently, it is desirable that the thermal conductivity of the second heat conducting member 71 is lower than the thermal conductivity of the first thermal conducting member 49. For example, the thermal conductivity of each part is preferably in a relationship of: the first heat conducting member 49>the second heat conducting member 71>the substrate 41 of the heater unit 40>the fixing film 35.

According to the fixing device 30 of the first embodiment configured as described above, in the heat fixing device including the heat conducting member that performs heat exchange between the heater unit and the fixing film, it is possible to control the temperature of the fixing film more efficiently.

Generally, by providing the heat conducting member 49 on the back surface of the heater unit 40, the heat capacity on the back side of the heater unit 40 is increased, and the temperature increase in a non-sheet passing portion is alleviated. Thus, it is known that the productivity of the image forming processing for a small-sized sheet or the like can be improved, but the temperature increase of the fixing film 35 to operating temperature is delayed. On the other hand, according to the fixing device 30 of the first embodiment, by providing the second heat conducting member 71 capable of being controlled to be in contact with or separated from the fixing film 35, it is possible to improve the trade-off between the improvement in productivity and the delay in temperature increase of the fixing film.

Second Embodiment

The image forming apparatus according to a second embodiment is different from the image forming apparatus according to the first embodiment in that the image forming apparatus can operate in operation modes of a normal mode and a low power mode. The normal mode is the typical operating mode, and the low power mode is an operation mode in which the power consumption is lower than that in the normal mode. For example, as an example of the low power mode, there are operation modes such as a sleep mode and a power saving mode that operate in a state where some functions of the image forming apparatus are stopped or made unavailable. The image forming apparatus according to the second embodiment controls the state of the second heat conducting member according to such an operation mode. The image forming apparatus according to the second embodiment has the same hardware configuration as the image forming apparatus according to the first embodiment. Therefore, the details of the image forming apparatus according to the second embodiment will be described below using the same reference numerals as those in FIGS. 1 to 9B.

Figure 11:
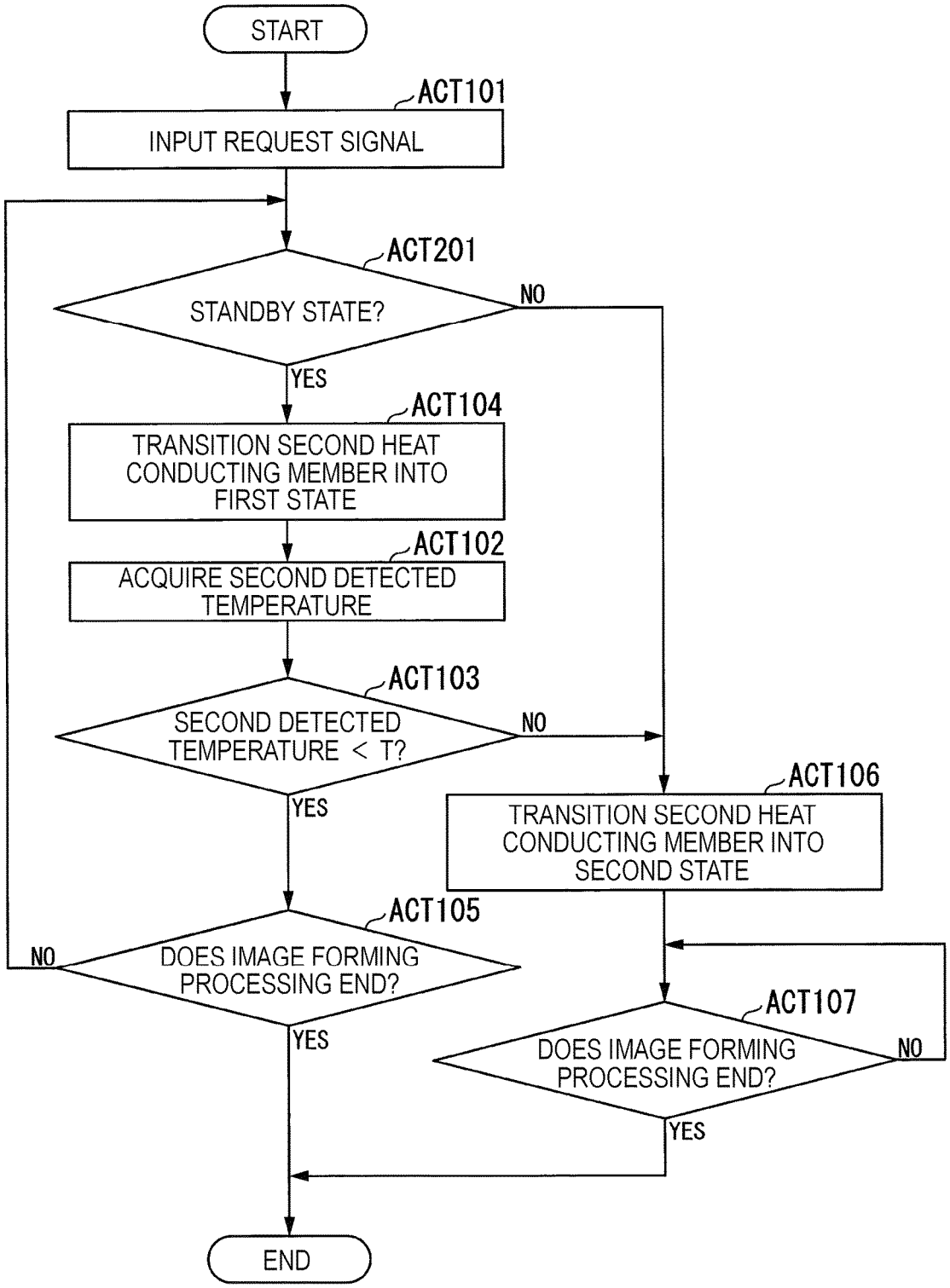
FIG. 11 is a flowchart depicting aspects of state control processing according to a second embodiment.

FIG. 11 is a flowchart illustrating a flow of a state control processing of the second heat conducting member 71 according to the second embodiment. Here, the same processes as the state control processing in the first embodiment are denoted by the same reference numerals as used in FIG. 10 and the description thereof can be omitted. In this second embodiment, when the request signal is input (ACT 101), the control unit 6 determines whether or not the present operation mode of the image forming apparatus 100 is the low power mode (ACT 201).

When the present operation mode is not the low power mode (NO in ACT 201), the control unit 6 causes the second heat conducting member 71 to transition to the second state (ACT 106). That is, the control unit 6 causes the second heat conducting member 71 to be in contact with the fixing film 35. On the other hand, when the present operation mode is the low power mode (YES in ACT 201), the control unit 6 causes the second heat conducting member 71 to transition to the first state (ACT 104). That is, the control unit 6 separates the second heat conducting member 71 from the fixing film 35.

Generally, the image forming apparatus is being controlled so as to make a transition between a ready state and a standby state. The ready state is a state in which the image forming processing can be executed without waiting or warmup, and the standby state requires some waiting or warmup after an execution request for the image forming processing is received. For example, the standby state can be a low power mode and/or a sleep mode. The sleep mode is an operation mode that operates with lower power consumption than even the low power mode.

Generally, the image forming apparatus in the standby state starts a preparation operation (hereinafter, referred to as "warming-up") for transitioning to the ready state in response to the input of a request signal, and transitions to the ready state upon completion of warming-up. On the other hand, the image forming apparatus in the ready state can be controlled to shift to the low power mode after the end of the image forming processing. Further, the image forming apparatus operating in the low power mode is controlled to shift to the sleep mode when an idle time (unused time) continues for a predetermined time or more.

In the image forming apparatus in the ready state, the second heat conducting member 71 is in a state of sufficiently being heated. Therefore, if the image forming apparatus is not in the standby state when the request signal is input, the second heat conducting member 71 is brought into contact with the fixing film 35 regardless of the second detected temperature. Thereby, the fixing device 30 of the second embodiment can more efficiently maintain the fixing film 35 at the fixing temperature.

On the other hand, in the image forming apparatus in the standby state, there is a high possibility that the second heat conducting member 71 is not yet sufficiently heated. Therefore, if the image forming apparatus is in the standby state when the request signal is input, the second heat conducting member 71 is initially separated from the fixing film 35 regardless of the second detected temperature. Then, when the second detected temperature becomes equal to or higher than the threshold T during the warming-up or the ready state, the second heat conducting member 71 is brought into contact with the fixing film 35. Thereby, the fixing device 30 of the second embodiment can prevent the heat of the fixing film 35 from being taken away by the second heat conducting member 71.

According to at least one embodiment described above, it is possible to more efficiently control the temperature of the fixing film in a fixing device which includes a heat conducting member performing heat exchange between a heater and a fixing film by providing the heat conducting members 49 and 71, at least one of which can be controlled to be in a first state in which a part thereof is in contact with the fixing film and a second state in which the part is not in contact with the fixing film. The heat conducting member 49 is an example of the first heat conducting member, and the heat conducting member 71 is an example of the second heat conducting member.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device, comprising:

a fixing member having a first surface configured to be pressed against a recording medium;

a heater on a second surface of the fixing member and configured to heat the fixing member;

a first heat conducting member contacting a back surface side of the heater; and a second heat conducting member that is moveable between a first state in which the second heat conducting member is in contact with the first heat conducting member and the second surface of the fixing member and a second state in which the second heat conducting member is contacting the first heat conducting member, but separated from the second surface of the fixing member.

2. The fixing device according to claim 1, wherein the fixing member is a cylindrical fixing belt, and the second surface is an inward facing surface of the cylindrical fixing belt.

3. The fixing device according to claim 1, wherein the heater is an on-demand type heater.

4. The fixing device according to claim 1, further comprising:

a movement mechanism attached to the second heat conducting member and configured to move the second heat conducting member between the first and second states.

5. The fixing device according to claim 4, wherein the movement mechanism comprises a cam.

6. The fixing device according to claim 1, wherein the second heat conducting member contacts the second surface at a position on a upstream side of the heater relative to a travel direction of the recording medium past the fixing member.

7. The fixing device according to claim 1, further comprising:

a controller configured to control the second heat conducting member to be in the first state when a temperature detected by a temperature sensor on the first heat conducting member is less than a predetermined threshold temperature value and the second state when the temperature detected by the temperature sensor is equal to or greater than the predetermined threshold temperature value.

8. The fixing device according to claim 1, wherein the first heat conducting member extends beyond the heater in an upstream direction, and the second heat conducting member has a U-shaped cross-section and covers an upstream edge of the heater.

9. The fixing device according to claim 1, wherein in the first state, a lower branch portion of the second heat conducting member contacts a lower facing surface of the first heat conducting member, and in the second state, the lower branch portion of the second heat conducting member contacts the second surface and an upper branch portion of the second heat conducting member contacts an upper surface of the first heat conducting member.

10. An image forming apparatus, comprising:

an image forming unit configured to form an image on a recording medium;

a fixing device configured to receive the recording medium from the image forming unit and fix the image to the recording medium with heat and pressure, the fixing device including:

a fixing member having a first surface configured to be pressed against the recording medium;

a heater on a second surface of the fixing member and configured to heat the fixing member;

a first heat conducting member contacting a back surface side of the heater; and a second heat conducting member that is moveable between a first state in which the second heat conducting member is in contact with the first heat conducting member and the second surface of the fixing member and a second state in which the second heat conducting member is contacting the first heat conducting member, but separated from the second surface of the fixing member.

11. The image forming apparatus according to claim 10, wherein the fixing member is a cylindrical fixing belt, and the second surface is an inward facing surface of the cylindrical fixing belt.

12. The image forming apparatus according to claim 10, wherein the heater is an on-demand type heater.

13. The image forming apparatus according to claim 10, wherein the fixing device further comprises:

a movement mechanism attached to the second heat conducting member and configured to move the second heat conducting member between the first and second states.

14. The image forming apparatus according to claim 13, wherein the movement mechanism comprises a cam.

15. The image forming apparatus according to claim 10, wherein the second heat conducting member contacts the second surface at a position on a upstream side of the heater relative to a travel direction of the recording medium past the fixing member.

16. The image forming apparatus according to claim 10, further comprising:

a controller configured to control the second heat conducting member to be in the first state when a temperature detected by a temperature sensor on the first heat conducting member is less than a predetermined threshold temperature value and the second state when the temperature detected by the temperature sensor is equal to or greater than the predetermined threshold temperature value.

17. The image forming apparatus according to claim 10, wherein the first heat conducting member extends beyond the heater in an upstream direction, and the second heat conducting member has a U-shaped cross-section and covers an upstream edge of the heater.

18. The image forming apparatus according to claim 10, wherein in the first state, a lower branch portion of the second heat conducting member contacts a lower facing surface of the first heat conducting member, and in the second state, the lower branch portion of the second heat conducting member contacts the second surface and an upper branch portion of the second heat conducting member contacts an upper surface of the first heat conducting member.

19. A method of controlling a fixing device for fixing an image to a recording medium, the method comprising:

detecting a temperature of a first heat conducting member contacting a back surface side of a heater on an inner facing surface of a fixing belt; and controlling a position of a second heat conducting member according to the detected temperature of the first heat conducting member such that the second heat conducting member is in a first state when the detected temperature is less than a predetermined threshold temperature value and in a second state when the detected temperature is equal to or greater than the predetermined threshold temperature value, wherein in the first state, the second heat conducting member is in contact with the first heat conducting member and the inner facing surface of the fixing belt, and in the second state, the second heat conducting member is contacting the first heat conducting member, but separated from the inner facing surface of the fixing belt.

20. The method according to claim 19, wherein the first heat conducting member extends beyond the heater in an upstream direction, and the second heat conducting member has a U-shaped cross-section and covers an upstream edge of the heater.

* * * * *